US007993160B1

(12) United States Patent
Sun et al.

(10) Patent No.: US 7,993,160 B1
(45) Date of Patent: Aug. 9, 2011

(54) RECEPTACLE CONNECTOR

(75) Inventors: Yan Sun, Guang-Dong (CN); Kai-Hsiang Chang, Tu-Cheng (TW); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/832,968

(22) Filed: Jul. 8, 2010

(51) Int. Cl.
*H01R 13/648* (2006.01)

(52) U.S. Cl. ..... 439/607.38; 439/676

(58) Field of Classification Search ..... 439/607.38, 439/660, 606, 676, 924.1, 941
See application file for complete search history.

(56) References Cited

U.S. PATENT DOCUMENTS 6,146,209 A * 11/2000 Francis ..... 439/676
6,695,649 B1 * 2/2004 Ciezak et al. ..... 439/676
7,097,513 B2 * 8/2006 Bryan ..... 439/676
7,238,060 B1 * 7/2007 Lee et al. ..... 439/676
7,241,157 B2 * 7/2007 Zhuang et al. ..... 439/188
7,651,380 B2 * 1/2010 Below et al. ..... 439/676

* cited by examiner

*Primary Examiner* — Thanh-Tam T Le
(74) *Attorney, Agent, or Firm* — Cheng-Ju Chiang

(57) ABSTRACT

An insulating housing defines an accommodating chamber and a receiving cavity in a bottom thereof. The bottom of the insulating housing defines a plurality of first terminal passages arranged at intervals along a traverse direction thereof and extends longitudinally to penetrate therethrough. The first terminal passages communicate with the accommodating chamber. A plurality of second terminal passages are arranged at intervals along a traverse direction thereof. A terminal module includes a terminal base disposed in the receiving cavity and a plurality of terminals molded together with the terminal base and arranged side by side. Each terminal has a fastening portion. A front end of the fastening portion extends forward to form a connecting portion which is arched upward and rearward to form a substantially oblique U-shaped bending portion. A free end of the bending portion extends along a tangent direction thereof to form a contacting portion.

5 Claims, 5 Drawing Sheets

RECEPTACLE CONNECTOR

BACKGROUND OF THE INVENTION

1. Field of the Invention

The present invention generally relates to a receptacle connector, and more particularly to a receptacle connector with a terminal module capable of avoiding elastic deformation of terminals thereof.

2. The Related Art

A traditional receptacle connector for connecting with a mating plug connector generally includes a square insulating housing, a terminal module and a shielding shell. The insulating housing defines an accommodating chamber penetrating through a mating surface thereof for receiving a plug connector therein. The terminal module includes a plurality of terminals and a terminal base. Each of the receptacle terminals has a fixing portion, one end of the fixing portion extends perpendicularly to form a soldering portion, the other end of the fixing portion is bent opposite to the soldering portion to form a bending portion, a free end of the bending portion extends rearward to form a connecting portion, a free end of the connecting portion extends along a rearward and upward direction to form a contacting portion. The terminal module is mounted in the insulating housing, the terminals are molded together with the terminal base and stretch into the accommodating chamber for electrically connecting with the plug connector. The shielding shell is mounted around the insulating housing. When the plug connector is inserted into the accommodating chamber of the insulating housing, plug terminals of the plug connector respectively press the contacting portions of the receptacle terminals down and an electrical connection is achieved.

However, when the receptacle terminals are pressed down by the plug terminals of the plug connector, pressure may be concentrated on the contacting portion so as to result in an elastic permanent deformation, as a result the plug terminals of the plug can't be contacted with the receptacle terminals well and electrical signal transmissions are bad.

SUMMARY OF THE INVENTION

An object of the present invention is to provide an receptacle connector adapted for connecting with a complementary plug connector. The receptacle connector includes an insulating housing, a terminal module, two clipping elements and a shielding shell. The insulating housing defines an accommodating chamber having an open front end for receiving the plug connector therein and a receiving cavity in a bottom thereof. A front portion of the receiving cavity communicates with a bottom of the accommodating chamber. A rear portion of the receiving cavity passes through a lower portion of a rear wall of the insulating housing with a connecting block formed thereunder. The bottom of the insulating housing defines a plurality of first terminal passages arranged at intervals along a traverse direction thereof and extending longitudinally to penetrate therethrough. The first terminal passages communicate with the accommodating chamber. The connecting block defines a plurality of second terminal passages arranged at intervals along a traverse direction thereof. Each of the second terminal passages extend longitudinally to pass through a front and a rear of the connecting block and further penetrate through a bottom of the connecting block to communicate with the receiving cavity. Fronts of the second terminal passages communicate with the accommodating chamber. A terminal module includes a terminal base disposed in the receiving cavity and a plurality of terminals are molded together with the terminal base and arranged side by side. Each terminal has a fastening portion. A front end of the fastening portion extends forward to form a connecting portion. The connecting portion slants along a downward and forward direction, further are arched upward and rearward to form a substantially oblique U-shaped bending portion. A free end of the bending portion extends along a tangent direction thereof to form a contacting portion. The fastening portions and the connecting portions are molded in the terminal base. The bending portions are positioned in the corresponding first terminal passages. The contact portions stretch into the accommodating chamber for electrically connecting with the plug connector. Free ends of the contact portions are positioned in the corresponding second terminal passages.

As described above, the contacting portion is formed by a free end of the bending portion extending along a tangent direction thereof. When the plug connector is inserted into the accommodating chamber of the receptacle connector, pressure can be afforded averagely by the bending portion and the contacting portion, so that an elastic deformation of the terminals can be avoided, and a contact reliability of the terminals and plug terminals is improved, and electrical signals can be transmitted normally.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
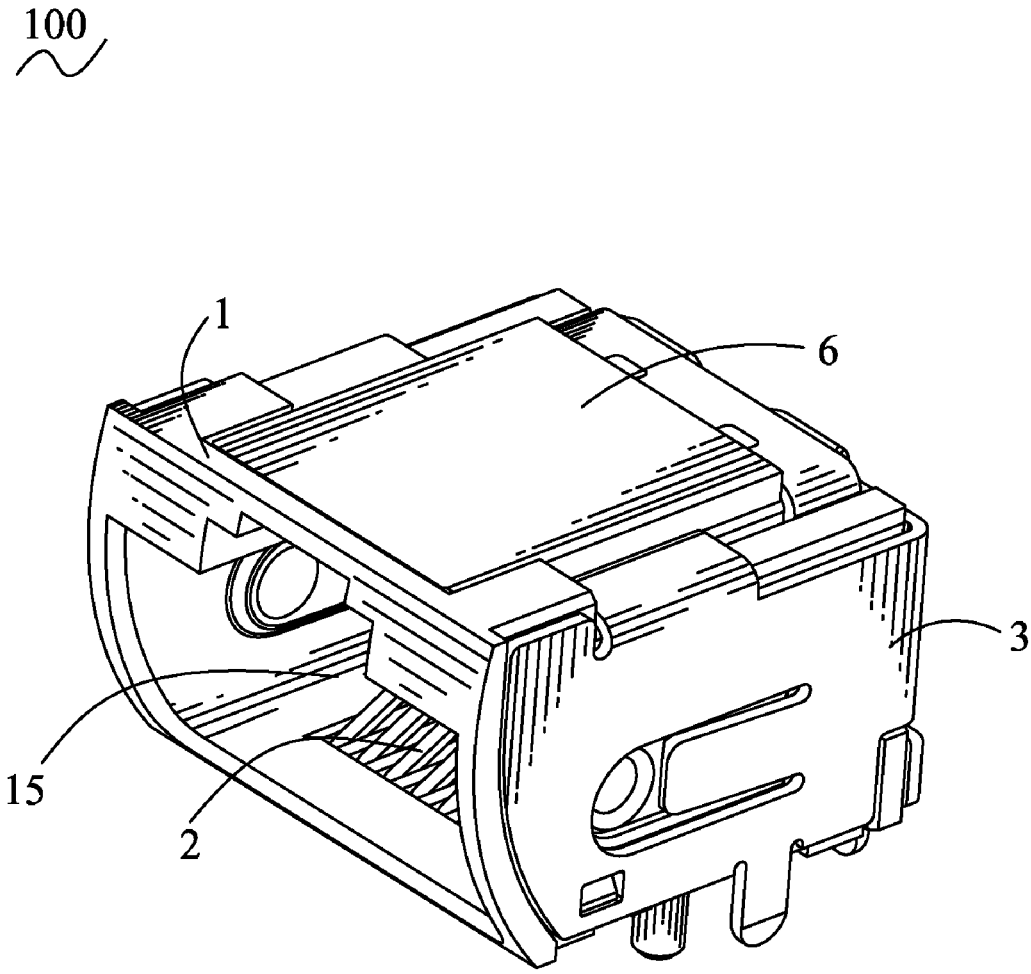
FIG. 1 is a perspective view of a receptacle connector in accordance with the present invention.
Figure 2:
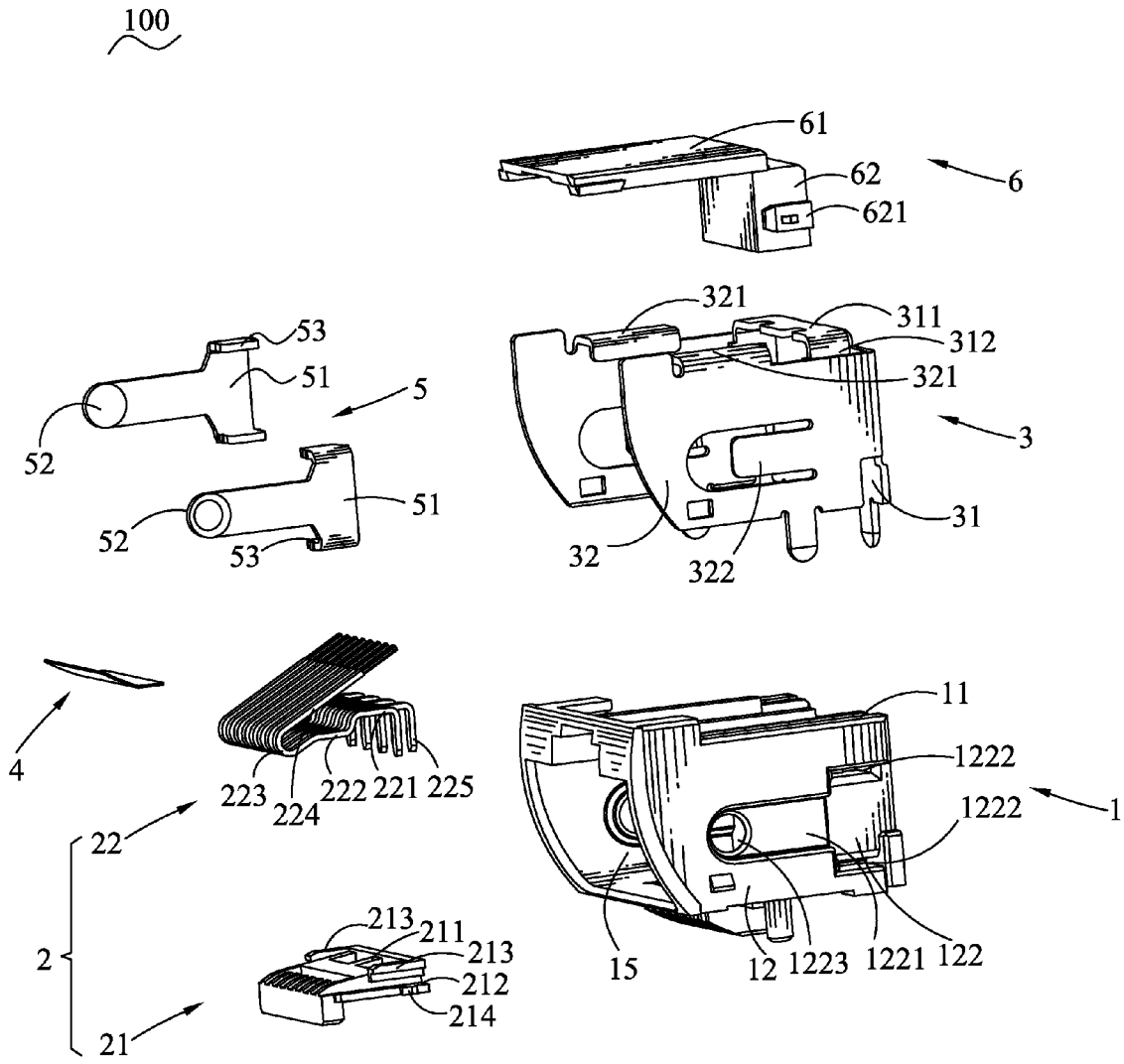
FIG. 2 is an exploded perspective view of the receptacle connector of FIG. 1.

With reference to FIG. 1 and FIG. 2, a receptacle connector 100 in accordance with the present invention includes an insulating housing 1, a terminal module 2, a shielding shell 3, an insulating slice 4, two clipping elements 5 and a cover 6.

Figure 3:
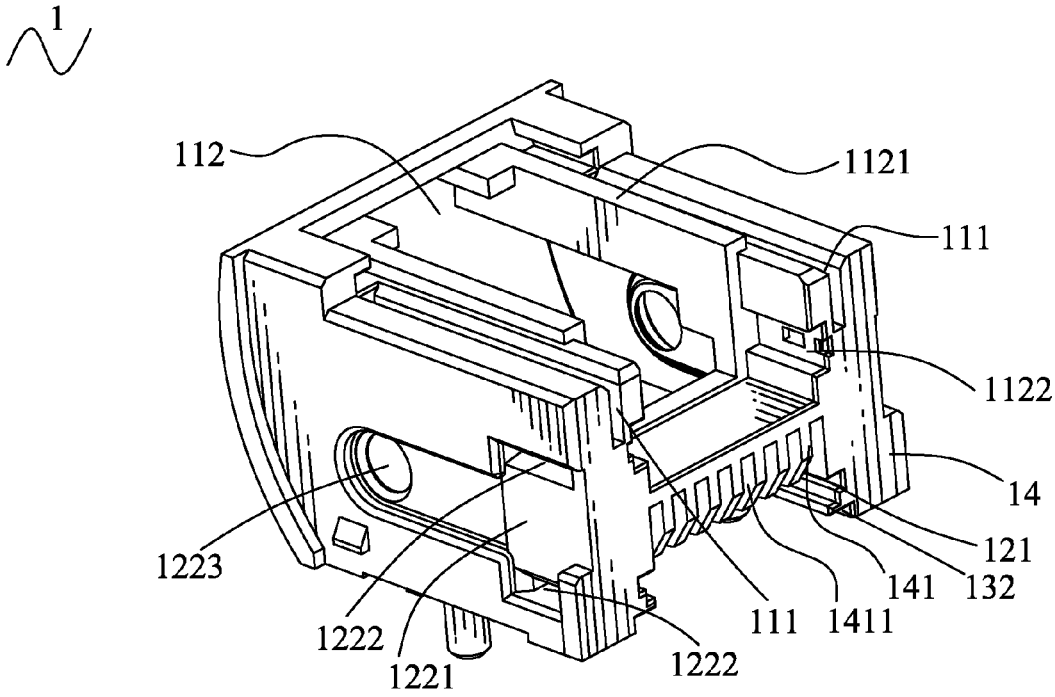
FIG. 3 is a perspective view of an insulating housing of the receptacle connector of FIG. 1.
Figure 4:
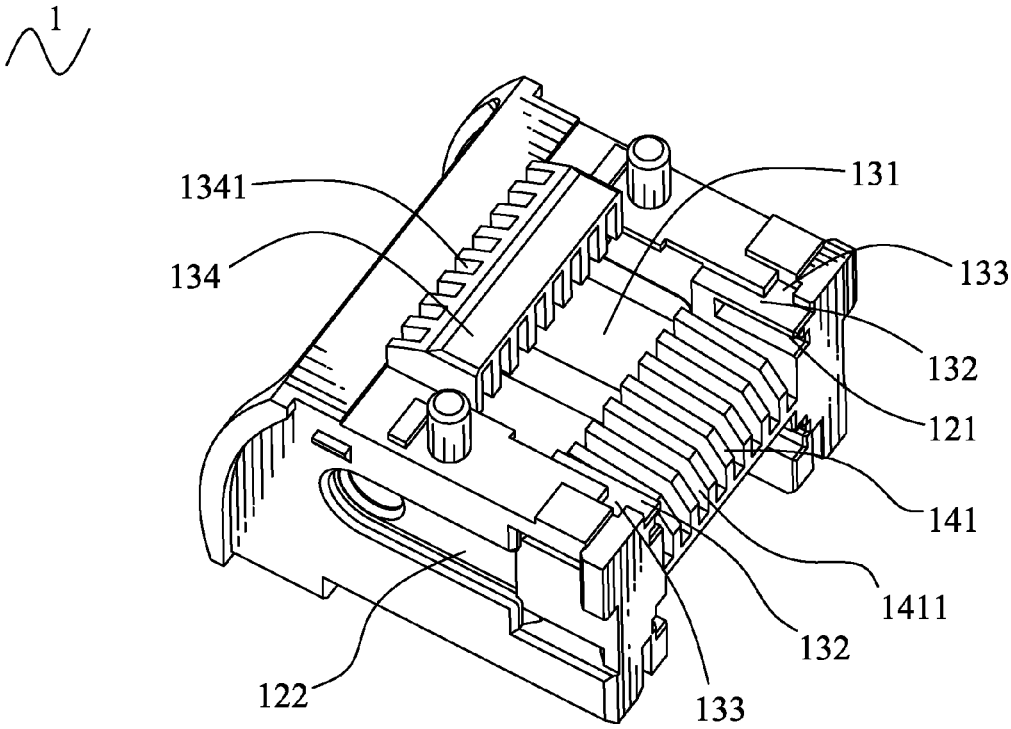
FIG. 4 is another perspective view of the insulating housing of the receptacle connector of FIG. 1.

Referring to FIG. 2, FIG. 3 and FIG. 4, the insulating housing 1 defines a top wall 11, two side walls 12, a bottom wall 13 opposite to the top wall 11 and a rear wall 14 connected with rear edges of the top wall 11, the side walls 12 and the bottom wall 13. The top wall 11, the side walls 12, the bottom wall 13 and the rear wall 14 are interconnected to form an accommodating chamber 15 thereamong. Two sides of the top wall 11 respectively define a fastening slot 111 passing through the rear wall 14. A middle of the top wall 11 defines an opening groove 112 penetrating therethrough and passing through an upper portion of the rear wall 14. Tops of fronts of inner sidewalls of the opening groove 112 protrude face to face to form two supporting portions 1121. Rear portions of the inner sidewalls of the opening grooves 112 concave oppositely to form two fillisters 1122. An outside of each of the two side walls 12 defines a lying T-shape locking groove 122 with a front narrower than a rear thereof. An upper end and a lower end of a rear of an inside 1221 of the locking groove 122 are concaved inward to form two inserting slots 1222, respectively. A front of the inside 1221 of the locking groove 122 defines a locking hole 1223 communicating with the accommodating chamber 15.

Referring to FIG. 2, FIG. 3 and FIG. 4 again, a middle of the bottom wall 13 of the insulating housing 1 defines a receiving cavity 131 penetrating therethrough to communicate with the accommodating chamber 15 and passing through a lower portion of the rear wall 14. Lower portions of two inner sidewalls of the receiving cavity 131 define two guiding channels 132 passing through the rear wall 14 and two fastening fillisters 133 connecting with rears of outer sides of the guiding channels 132, respectively. The inner sidewalls of the receiving cavity 131 further define two ladder-shaped locating grooves 121 passing through the rear wall 14 and located above the guiding channels 132, respectively. A front of the bottom wall 13 protrudes downward to form a protrusion 134. The protrusion 134 defines a plurality of first terminal passages 1341 arranged at regular intervals along a traverse direction thereof and each extending longitudinally and vertically to penetrate through the bottom wall 13. The first terminal passages 1341 are communicated with the accommodating chamber 15. A connecting block 141 is formed in a middle of the rear wall 14 and located between a rear of the opening groove 112 and a rear of the receiving cavity 131. The connecting block 141 defines a plurality of second terminal passages 1411 arranged at regular intervals along a traverse direction thereof. Each of the second terminal passages 1411 extend longitudinally to pass through a front and a rear of the connecting block 141 and further penetrate through a bottom of the connecting block 141. The second terminal passages 1411 are communicated with the accommodating chamber 15 and the receiving cavity 131. Two side walls 12 concave oppositely to form two ladder-shape locating grooves 121 passing through the rear wall 14 and located above the guiding channels 132, respectively.

Figure 5:
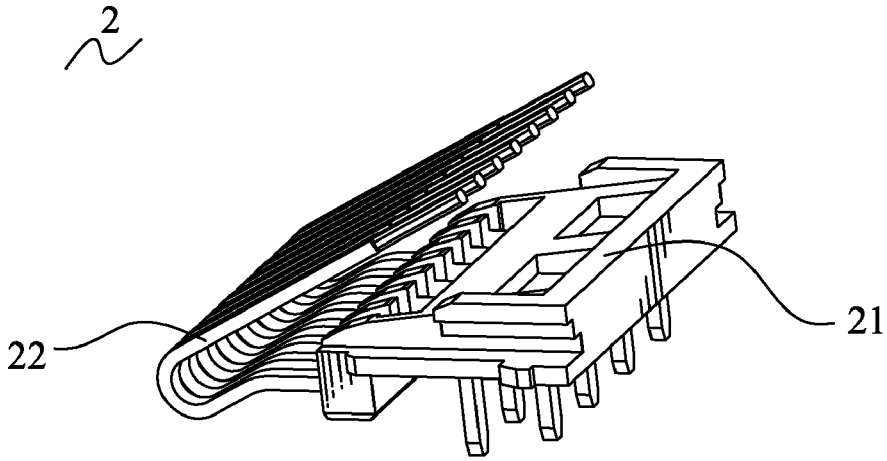
FIG. 5 is a perspective view of a terminal module of the electrical connector in accordance with the present invention.
Figure 6:
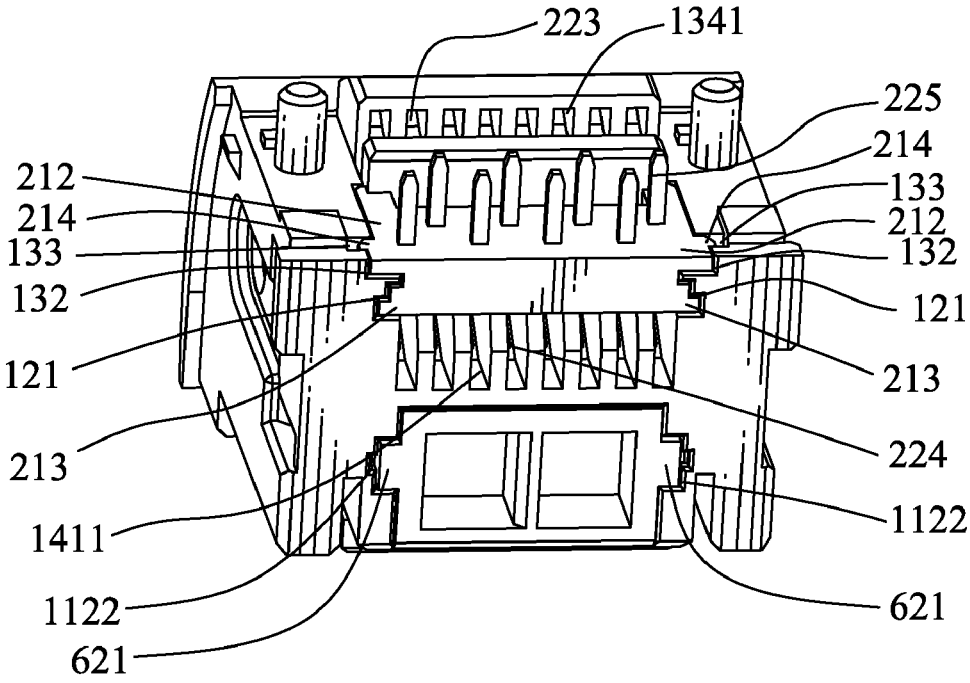
FIG. 6 is an assembling view of the terminal module of FIG. 5 and the insulating housing of FIG. 4.

Referring to FIG. 2 and FIG. 5, the terminal module 2 includes a terminal base 21 and a plurality of terminals 22. The terminal base 21 has a base body 211, bottoms of two sides of the base body 211 extend outward to form two elongated guiding ribs 212 with two fixing blocks 214 protruded at two outside edges thereof. Tops of the two sides of the base body 211 extend outward to form two ladder-shape locating portions 213. Each of the terminals 22 is stamped from a metal bar and has a fastening portion 221. One end of the fastening portion 221 extends downward and then forward to form a connecting portion 222. A free end of the connecting portion 222 slants along a downward and forward direction, and further is arched rearward and upward to form a substantially oblique U-shaped bending portion 223. A free end of the bending portion 223 extends along a tangent direction thereof to form a contacting portion 224. The other end of the fastening portion 221 extends downward to form a soldering portion 225. The terminals 22 are molded together with the terminal base 21. The fastening portion 221 and the connecting portion 222 are molded in the base body 211 of the terminal base 21, the bending portion 223 is located in front of the base body 211, a free end of the contacting portion 224 are located above the base body 211, and the soldering portion 225 is protruded under the base body 211.

Referring to FIG. 2, the shielding shell 3 is punched from a metal plate. The shielding shell 3 defines a rear plate 31. Two sides of the rear plate 31 respectively extend frontward to form a side plate 32. Rear portions of tops of the two side plates 32 respectively extend upward to form a propping plate 312. A fastening plate 312 perpendicularly connects tops of the two propping plates 312. Front portions of the tops of the side plates 32 extend inward, and then are bent downward to form two fixing slices 321. Middles of the side plates 32 are respectively punched inward to form two clipping pieces 322.

Referring to FIG. 2, the clipping element 5 has a lying T-shape clipping portion 51, a front of the clipping portion 51 narrower than a rear thereof protrude sideward to form a locking block 52. Two sides of the rear of each clipping portion 51 extend towards the same direction as the locking block 52 to form two inserting pieces 53.

Referring to FIG. 2 again, the cover 6 has a base plate 61, one end of the base plate 61 extends downward to form a supporting portion 62 with two fastening blocks 621 being protruded at two sides thereof.

Figure 7:
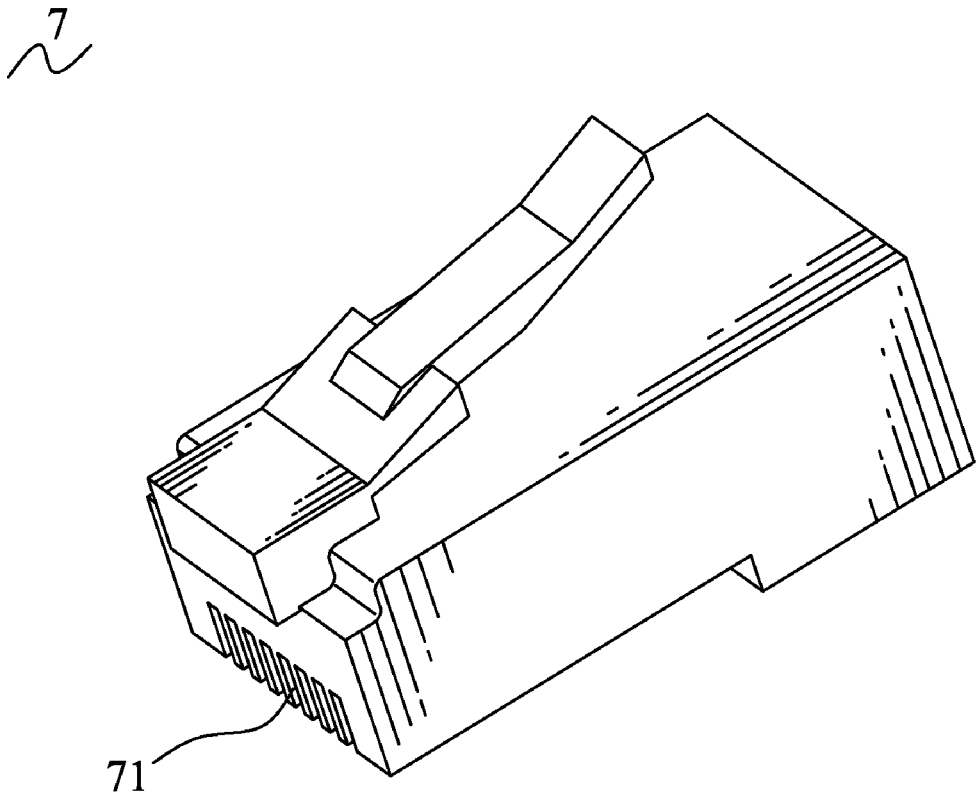
FIG. 7 is a perspective view of a plug connector mated with the electrical connector of FIG. 1.

Referring to FIGS. 1-6, when the receptacle connector 100 is assembled, the terminal module 2 is disposed in the insulating housing 1, and more specially the guiding ribs 212 can slide in the corresponding guiding channels 132 to make the base body 211 rightly received in the receiving cavity 131. The fixing blocks 214 are buckled into the corresponding fastening fillisters 133 and the locating portions 213 are received in the locating grooves 121 so that the terminal base 21 can be firmly assembled in the insulating housing 1. The bending portions 223 of the terminals 22 are received in the corresponding first terminal passages 1341. The contacting portions 224 are received in the accommodating chamber 15 to electrically connect with plug terminals 71 of a plug connector 7 shown in FIG. 7, and free ends thereof are stretched into the corresponding second terminal passages 1411 for preventing the terminals 22 swaying and firmly restraining the terminals 22 in the insulating housing 1. The clipping elements 5 are received in the locking grooves 122 of the insulating housing 1. The locking blocks 52 are inserted into the locking holes 1223 and the inserting pieces 53 are inserted into the inserting slots 1222. The cover 6 is mounted to a top of the insulating housing 1. The base plate 61 and the supporting portion 62 are received in the opening groove 112 with the base plate 61 being supported on the supporting portions 1121, two fastening blocks 621 being received in the two fillisters 1122 and a bottom of the supporting portion 62 being abutted against a top of the connecting block 141. The shielding shell 3 is mounted around the insulating housing 1 with the propping plates 312 and the fixing slices 321 being inserted into the fastening slots 111. The clipping pieces 322 of the shielding shell 3 are received in the locking grooves 1221 and abutted against the clipping portions 51 of the clipping elements 5. The insulating slice 4 is covered on a bottom of the protrusion 134.

As described above, the contacting portion 224 is formed by the free end of the bending portion 223 extending along a tangent direction thereof. When the plug connector 7 is inserted into the accommodating chamber 15 of the receptacle connector 100, pressure can be shared by the bending portion 223 and the contacting portion 224, so that an elastic deformation of the terminals 22 is avoided, and a contact reliability of the terminals 22 and the plug terminals 71 is improved, and electrical signals can be transmitted normally.

What is claimed is:

1. A receptacle connector adapted for connecting with a complementary plug connector, comprising:

an insulating housing defining an accommodating chamber having an open front end for receiving the plug connector therein and a receiving cavity in a bottom thereof, a front portion of the receiving cavity communicating with a bottom of the accommodating chamber, a rear portion of the receiving cavity passing through a lower portion of a rear wall of the insulating housing, with a connecting block formed thereunder, the bottom of the insulating housing defining a plurality of first terminal passages arranged at intervals along a traverse direction thereof and extending longitudinally to penetrate therethrough, the first terminal passages communicating with the accommodating chamber, the connecting block defining a plurality of second terminal passages arranged at intervals along a traverse direction thereof, each of the second terminal passages extend longitudinally to pass through a front and a rear of the connecting block and further penetrating through a bottom of the connecting block to communicate with the receiving cavity, fronts of the second terminal passages communicating with the accommodating chamber; and a terminal module including a terminal base disposed in the receiving cavity and a plurality of terminals molded together with the terminal base and arranged side by side, each terminal having a fastening portion, a front end of the fastening portion extending forward to form a connecting portion, the connecting portion slanting along a downward and forward direction, further being arched upward and rearward to form a substantially oblique U-shaped bending portion, a free end of the bending portion extending along a tangent direction thereof to form a contacting portion;

wherein the fastening portions and the connecting portions are molded in the terminal base, the bending portions are positioned in the corresponding first terminal passages, the contact portions stretch into the accommodating chamber for electrically connecting with the plug connector, free ends of the contact portions are positioned in the corresponding second terminal passages.

2. The receptacle connector as claimed in claim 1, wherein two inner sidewalls of the receiving cavities define two guiding channels passing through the rear wall, two fastening fillisters connecting with rears of outer sides of the guiding channels, and two locating grooves passing through the rear wall and above the respective guiding channels, the terminal base has a base body, bottoms of two sides of the base body extend outward to form two guiding ribs with two fixing blocks being protruded at two side edges thereof, tops of the two sides of the base body extend outward to form two locating portions, the two guiding ribs slide and are received the guiding channels with two fixing blocks being stretched into the two fastening fillisters, the locating portions are received in the locating grooves.

3. The receptacle connector as claimed in claim 1, further comprising two clipping elements, each of the clipping elements has a clipping portion, a front of the clipping portion protrudes sideward to form a locking block, the insulating housing defines two side walls, an outside of each of the two side walls defines a locking groove, an inside of the locking groove defines a locking hole communicating with the accommodating chamber, the clipping elements are received in the locking grooves, the locking blocks are inserted into the locking holes.

4. The receptacle connector as claimed in claim 3, wherein the locking groove is a lying T-shape with a front narrower than a rear thereof, an upper end and a lower end of a rear of an inside of the locking groove are concaved inward to form two inserting slots, respectively, the locking hole is defined in a front of the inside of the locking groove, the clipping portion is a lying T-shape, a front of the clipping portion narrower than a rear thereof protrude sideward to form the locking block, two sides of the rear of each clipping portion extend towards the same direction as the locking block to form two inserting pieces for being inserted into the inserting slots.

5. The receptacle connector as claimed in claim 3, further comprising a shielding shell enclosing the insulating housing, the shielding shell has two side plates, middles of the side plates are respectively punched inward to form two clipping pieces, the clipping pieces are received in the locking grooves and abutted against the clipping portion of the clipping element.

* * * * *